United States Patent [19]

Murdock

[11] 4,388,916

[45] Jun. 21, 1983

[54] STEAM GENERATION APPARATUS

[76] Inventor: Albert L. Murdock, P.O. Box 71, Millers Creek, N.C. 28651

[21] Appl. No.: 307,615

[22] Filed: Oct. 1, 1981

[51] Int. Cl.[3] ..... F24J 3/02

[52] U.S. Cl. ..... 126/427; 126/437; 126/434; 202/234; 237/61

[58] Field of Search ..... 126/427, 433, 434, 437; 122/35; 237/66, 61; 202/234

[56] References Cited

U.S. PATENT DOCUMENTS

| | | | |
|---|---|---|---|
| 2,490,659 | 12/1949 | Snyder | 126/432 |
| 3,202,357 | 8/1965 | Carlson | 237/61 |
| 3,860,494 | 1/1975 | Hickman | 122/35 |
| 4,027,821 | 6/1977 | Hayes et al. | 126/427 |
| 4,034,738 | 7/1977 | Barber, Jr. | 126/427 |
| 4,050,445 | 9/1977 | Huse | 126/433 |
| 4,166,769 | 9/1979 | Dukess | 202/234 |
| 4,296,729 | 10/1981 | Cooper | 126/437 |
| 4,299,199 | 11/1981 | Girome | 126/437 |
| 4,340,030 | 7/1982 | Molivades | 126/433 |
| 4,366,807 | 1/1983 | Barber, Jr. | 126/434 |

*Primary Examiner*—Henry C. Yuen
*Attorney, Agent, or Firm*—Emory L. Groff, Jr.

[57] ABSTRACT

A steam generation apparatus includes a primary source of hot water supplied to an enclosed hot water receptacle maintained at a pressure of approximately 300 psi. Supply and return lines pump the hot water in a recirculating manner through a serially connected supplemental heating device until the hot water has reached a temperature of substantially 400° F. whereupon a thermal valve associated with the supplemental heating device opens to deliver the heated water to an expansion tank. Steam formed within the expansion tank is transmitted through a steam outlet line to appropriate using apparatus. The initial hot water source may alternately include industrial by-product heated waste water on a primary heating station serially connected between a water supply and the enclosed hot water receptacle. Water condensed in the expansion tank is recycled to either the hot water receptacle or primary heating station. Solar energy collector devices are readily adaptable for providing either or both the primary and supplemental heating of the water.

9 Claims, 4 Drawing Figures

STEAM GENERATION APPARATUS

This invention relates generally to the generation of steam and more particularly to an improved apparatus including highly efficient and economical heating means through which water is recirculated to raise the temperature to that necessary before the heater water under pressure is automatically directed to an expansion tank.

Many industrial operations rely upon the production of an enormous amount of steam and/or hot water to carry out the associated processes and until recent years, this requirement has been largely met by generating apparatus operating with conventional fuels. With the recent significant rise in the cost of conventional fuels, means have been sought to more economically produce the large amount of steam or hot water required by many industries.

Many manufacturing processes, such as food processing installations, produce a vast amount of hot water as a waste product and by means of the instant invention, this waste water can serve as the starter fluid which may be further heated to economically produce steam which is subsequently used in the processing systems, such as food canning or poultry processing. The steam produced by the present invention may alternatively be employed to operate a water purification system. In the latter instance, the steam is circulated through an appropriate grid network within the body of impure water such as a swamp or polluted stream whereupon the generated water vapor is subsequently condensed to yield a pure supply of water which in turn may be used in any manner desired.

Solar energy collector devices of the well known type wherein a fluid is adapted to be directed therethrough are an extremely economical source for providing the necessary heating of the water for producing the steam in this invention and one or more solar collectors are employed to provide both a primary heating of the water as well as the supplemental heating thereof. Pump mechanisms are utilized along with inlet and outlet lines to the plurality of solar collector devices to provide a recirculation of the hot water until its temperature has been raised to a specified level and the heated water is subsequently maintained under a substantial pressure head within a high pressure, high temperature tank until its temperature is elevated to still a higher level by means of a supplemental water heating device. Upon obtaining a required temperature, the hot water under pressure is automatically directed from the supplemental heating means by means of a regulator valve to an expansion tank wherein the heated water now at a lower pressure, flashes into steam which is subsequently directed to a steam supply line. Condensed water within the expansion tank is recycled to the primary water heating means such that no waste product issues from the generation apparatus of the present invention.

In case of a manufacturing process wherein a steady source of heated waste water is available, the primary water heating means may be eliminated with the heated supply water being pumped directly into the high pressure, high temperature tank. In either instance, the elevated pressure maintained in the tank may alternately be provided by means of high pressure pumps supplying water thereto or by means of an air compressor associated with the upper portion of the tank and maintaining a pressure head atop the water level therein.

Accordingly, one of the objects of the present invention is to provide an improved steam generation apparatus including primary water heating means receiving supply water and serially connected with a high pressure hot water tank in turn serially connected to supplemental heating means from which high pressure, high temperature water is directed to an expansion tank.

Another object of the present invention is to provide an improved steam generation apparatus including a plurality of water heating means serially connected with an intermediate hot water tank having pump means for maintaining a high pressure therein with regulating means automatically directing hot water from the last water heating means to an expansion tank.

A further object of the present invention is to provide an improved steam generator apparatus including a plurality of water heating means with a pressurized hot water tank therebetween with all components serially connected by water lines to provide a recirculation of water being heated by each of the heating means.

Another object of the present invention is to provide an improved steam generation apparatus including a pressurized hot water tank and an expansion tank with a serially connected intermediate solar energy hot water heating device together with means automatically regulating the flow of hot water therefrom to the expansion tank upon the attainment of a specified temperature.

With these and other objects in view, which will more readily appear as the nature of the invention is better understood, the invention consists of the novel construction, combination and arrangement of parts hereinafter more fully described, illustrated and claimed.

Similar reference characters designate corresponding parts throughout the several views of the drawings.

Figure 1:
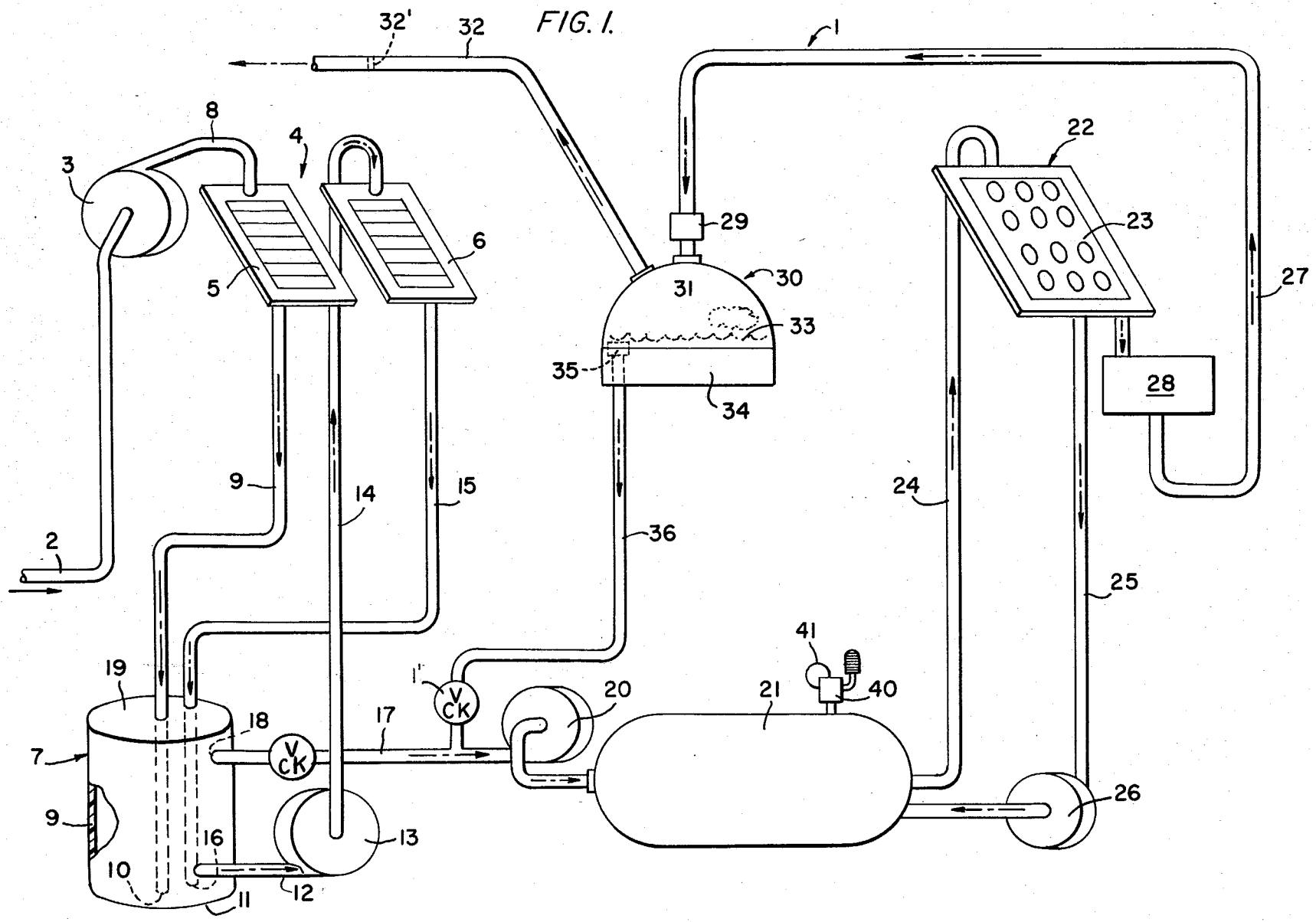
FIG. 1 is a diagrammatic view of a steam generation apparatus according to the present invention.

Referring now to the drawings, particularly FIG. 1, the present invention will be seen to include a steam generation apparatus generally designated 1 and which receives its starter fluid or supply water at an inlet line 2. The source for this water supply may comprise heated waste water, such as from a manufacturing process, when this is available. Otherwise, an appropriate source of cold water may be used. The inlet line 2 is provided with an inlet or supply pump 3 which directs the incoming supply water through a primary water heating means, generally designated 4. This heating means preferable comprises conventional solar energy collectors and the maximum amount of heat energy may be transmitted to the incoming supply water by employing a plurality of heating devices such as the first solar energy collector 5 and second solar energy collector 6. Usually, a minimum of two such collectors will be required and these are associated, as shown in FIG. 1 of the drawings, with a hot water storage tank 7 joined by a plurality of water lines to provide a serial flow of the heated water through each one of the plurality of collectors 5–6 and the tank 7.

The supply pump 3 will be seen to direct the incoming water through an inlet line 8 leading to one end of the first solar collector 5. It is not necessary to describe the details of the construction of the solar energy collectors since many such devices have been available for some time and their operation is well known. It will be sufficient to mention that as water is transmitted from one end of a collector to the other, it is exposed to solar energy and progressively heated thereby. This heated water leaves the first collector 5 to a heated water outlet line 9.

The dimensions of the various components illustrated in the drawings are, of course, not proportional and it will be understood that the hot water storage tank 7 will have a relatively large capacity, say at least several thousand gallons and the hot water storage may be provided by a single large tank or a plurality of interconnected individual tanks. In any case, the tank walls will be understood to be substantially insulated as at 9 and additionally, in order to retain and stabilize the temperature of the heated water therein, heat retention means such as a rock fill (not shown) may be included within the interior of the tank.

The discharge point 10 of the heated water outlet line 9 is disposed within the lower reaches of the tank 7 adjacent its bottom 11. In this manner, the incoming heated water will stratify, that is rise to the upper portion of the tank 7 inasmuch as its temperature normally is greater than that of the water already disposed within the tank. The storage tank water is further heated by subsequently directing it through one or more additional solar energy collectors 6 by withdrawing the cooler water from adjacent the tank bottom 11 through an outlet line 12, which although positioned within the lower portion of the tank 7, will not be located so close to the discharge 10 of the line 9 as to draw away the incoming heated water.

A storage tank pump 13 is serially connected to the tank bottom outlet line 12 and produces a flow of the cooler water from the tank 7 through an inlet line 14 leading to one end of the second solar energy collector 6 and as this water traverses the collector 6 it is additionally heated to still a higher temperature before leaving the collector by the outlet line 15. This outlet line 15 likewise enters the insulated hot water storage tank 7 and includes a discharge point 16 adjacent the tank bottom 11 whereupon as long as the pumps 3 and 13 continue to operate, it will follow that a serial flow of water will be transmitted from the water supply in the line 2 and through all of the plurality of solar energy collectors 5–6 such that a progressively increasing temperature will be evident in the water contained within the storage tank 7. On the other hand, when the tank 7 is filled with heated water and no hot water is being discharged from the tank through its top outlet line 17, the storage tank pump 13 may continue to operate to maintain a recirculation of the tank water through at least the second solar collector 6 thereby further elevating the temperature of the water therein or at least maintaining the elevated temperature of the water.

Appropriate valve means (not shown) associated with the storage tank 7 and serving to regulate the operation of the pump 3 and/or pump 13, operate to maintain a pressure of 80 psi within the tank 7.

Circulation of the hot water heated by the primary heating means 4 and stored within the tank 7, to the remaining steam generating components occurs through the tank top outlet line 17 having its inlet 18 disposed adjacent the top 19 of the tank so as to draw off the hottest water contained within the tank. A high pressure pump 20 serially disposed within the outlet line 17 directs the heated water into a high pressure, high temperature tank 21 wherein the water is maintained under pressure of approximately 300 psi by means of an air compressor 40 including appropriate pressure regulating or valve means 41. As will be shown hereinafter, the tank 21 may include an internal piston serving to maintain a separation of the pressurized head atop the hot water. From this tank 21, the hot water is serially directed through supplemental water heating means 22 which may most economically comprise a high intensity solar energy collector 23, which devices are most noted for their capability to extract the maximum energy from a solar source and to pass this energy to a fluid body.

The hot water within the tank 21 will be understood to be recirculated through the supplemental heating device 22 such that the temperature thereof is progressively increased. This fluid circulation is provided by means of a recirculating supply line 24 leading from the high pressure high temperature tank 21 to one end of the solar energy collector 23 and a recirculating return line 25 which leads back to the tank 21 and includes therein a recirculating pump 26. By means of the valve means 41 and the high pressure pump 20, the pressure is regulated to maintain approximately 300 psi upon the hot water within the tank 21 and the recirculating pump 26 is preferable continuously operated to further heat the hot water by the supplemental heating means 22 until the temperature of the water in the tank is elevated to approximately 400° F.

A hot water delivery line 27 leading fom the supplemental heating means 22 includes a thermal regulator valve 28 therein which is normally closed while the temperature within the tank 21 and lines 24–25 is being elevated to approximately 400° F. When this temperature is reached, the regulator valve 28 automatically opens to direct this hot water through the delivery line 27 to a metering valve 29 associated with an expansion tank 30. The metering valve 29 will be understood to reduce the pressure of hot water as it enters the interior 31 of the expansion tank 30. The reduced pressure hot water, upon entering the confines 31 of the dome top of the expansion tank 30 flashes into steam which is drawn off through a steam supply or outlet line 32 at an appropriate pressure, for example, 100 psi. A suitable metering device 32' may be included in the line 32 to maintain the desired steam pressure.

Means are provided for collecting and utilizing the residual water accumulating as condensation 33 in the lower portion 34 of the expansion tank 30. This means includes an appropriate float mechanism 35 communicating with a water return line 36 which will be seen in FIG. 1 to discharge into the outlet line 17 intermediate the storage tank 7 and high pressure hot water tank 21 for reuse and circulation through the tank 21. This water leaves the expansion tank at approximately 100 psi and 337° F. and thus need not be recycled to the tank 7 since it is already at a higher temperature and pressure than the water in the tank 7. A check valve 1' prevents backflow through the return line 36 should a malfunction occur on either side of the valve.

Figure 2:
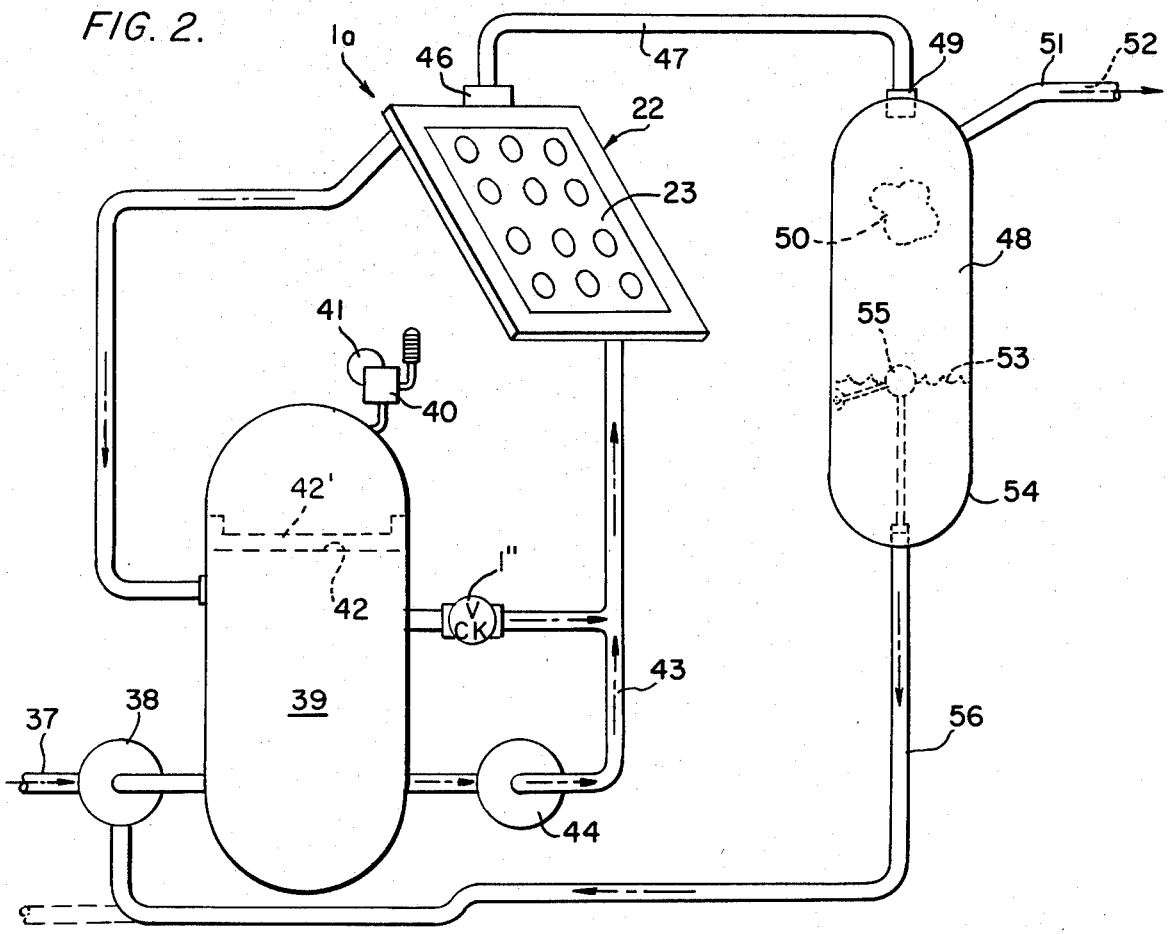
FIG. 2 is a diagrammatic illustration of another embodiment of the present invention.

The steam generation apparatus 1*a* shown in FIG. 2 of the drawings depicts an arrangement which alternately may be employed to generate steam when a source of substantially hot heated water is already available as a source fluid, such as hot waste water from a manufacturing process. In this modification, the heated water is introduced to the supply line 37 and is directed by means of a supply pump 38 to the lower reaches of a high pressure, high temperature tank 39. This tank includes an air compressor or pump means 40 automatically regulated such as by a valve 41, to maintain a pressure head atop the water level 42 which will subject the water contained in the tank to a pressure of approximately 300 psi. A suitable displaceable piston member 42' within the tank 39 maintains a demarcation between the pressurized air and hot water therein. The water within the tank 39 is serially directed through supplemental water heating means 22 which may comprise a high intensity solar energy collector 23 as in the embodiment of FIG. 1. This circulation is achieved by means of a recirculating supply line 43 extending from the lower portion of the high pressure, high temperature tank 39 and directed to one end of the supplemental heating means 22. A recirculating pump 44 in series with this line maintains a flow of the hot water through the solar energy collector 23 after which the hot water, which now has its temperature additionally elevated, is redirected to the upper portion of the tank 39 by means of a recirculating return line 45. In this manner, upon the continuous operation of the recirculating pump 34, it will be appreciated that the temperature of the water within the pressurized tank 39 will be progressively increased, ideally until elevated to approximately 400° F.

As in the first described embodiment, a thermal regulator valve 46 associated with the solar energy collector 23 is normally closed but is designed to open when the temperature of the water circulating through the supplemental heating means reaches say, 400° F. at which time the valve 46 opens to admit the heated water under pressure to the delivery line 47. This delivery line communicates with the dome top of an expansion tank 48 through a pressure reducing metering valve 49 and upon entering the interior 50 of the expansion tank, flashes into steam which is subsequently carried off by the supply or outlet line 51. The supply line 51 may maintain a steam pressure of 100 psi. Again, the condensation 53 forming in the lower portion 54 of the expansion tank 48 is recycled for use in the apparatus by means of a float valve 55 automatically directing the condensation through a water return line 56. The discharge portion of the water return line 56 may be connected to the suction side of the supply pump 38 or alternatively, as indicated by broken lines, redirected to primary heating means if associated with this embodiment.

Figure 3:
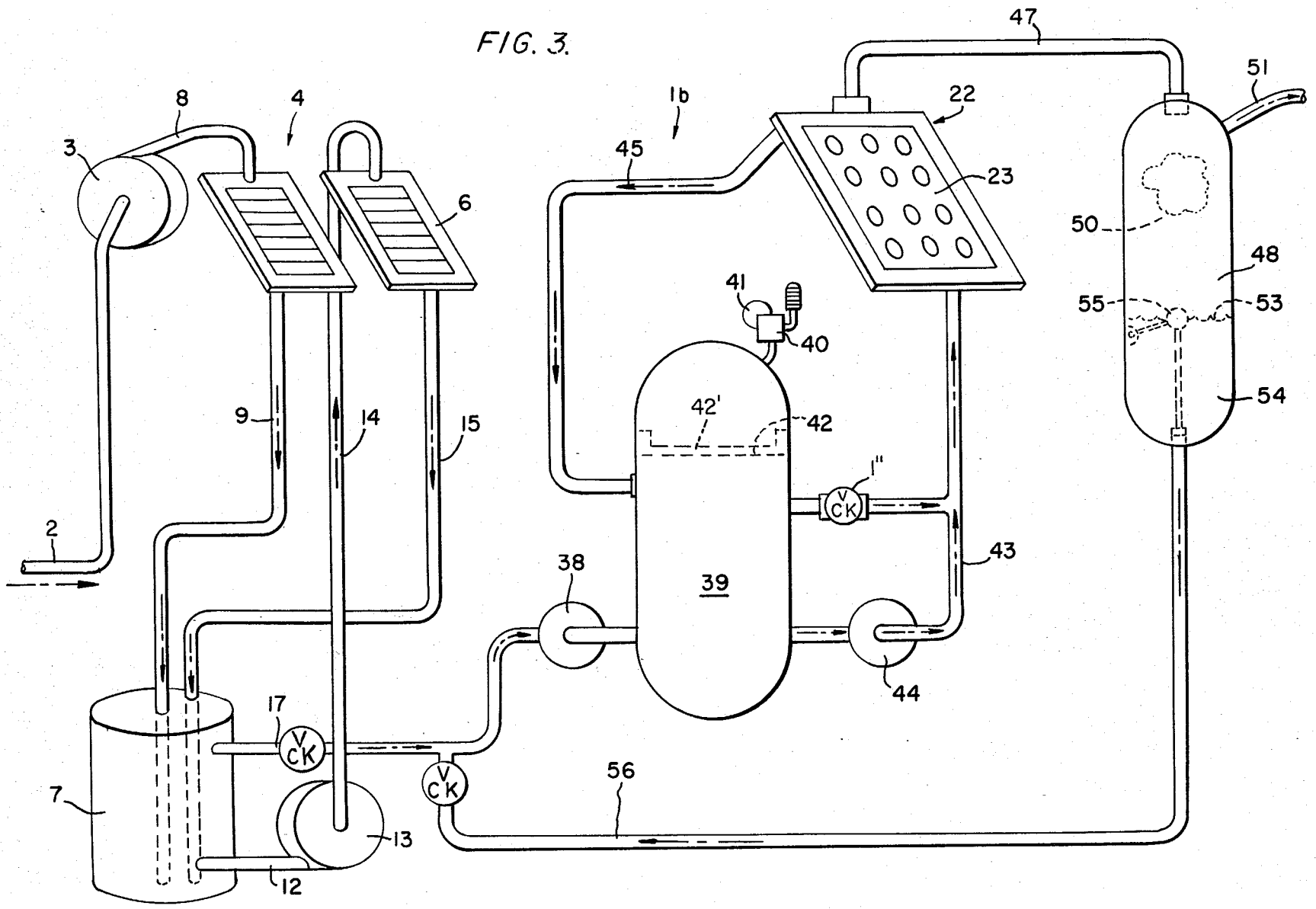
FIG. 3 is a diagrammatic illustration of an additional embodiment of the present invention.

The embodiment of FIG. 3 employs a primary water heating system as disclosed in the left-hand portion of the embodiment of FIG. 1 while the right-hand portion of FIG. 3 illustrates the just-described system of FIG. 2. With the arrangement of FIG. 3, the water return line 56 has its discharge portion communicating with the interior of the high pressure hot water tank 39 whereupon the lower temperature and pressure of the return water will be understood to be recirculated through the solar energy collector 23 until the recycled water is raised in temperature and pressure to approximately 300 psi at 400° F. A check valve 1'' in both the FIGS. 2 and 3 embodiments allows a safety by-pass of the pump 44, in the direction of the illustrated arrows.

Figure 4:
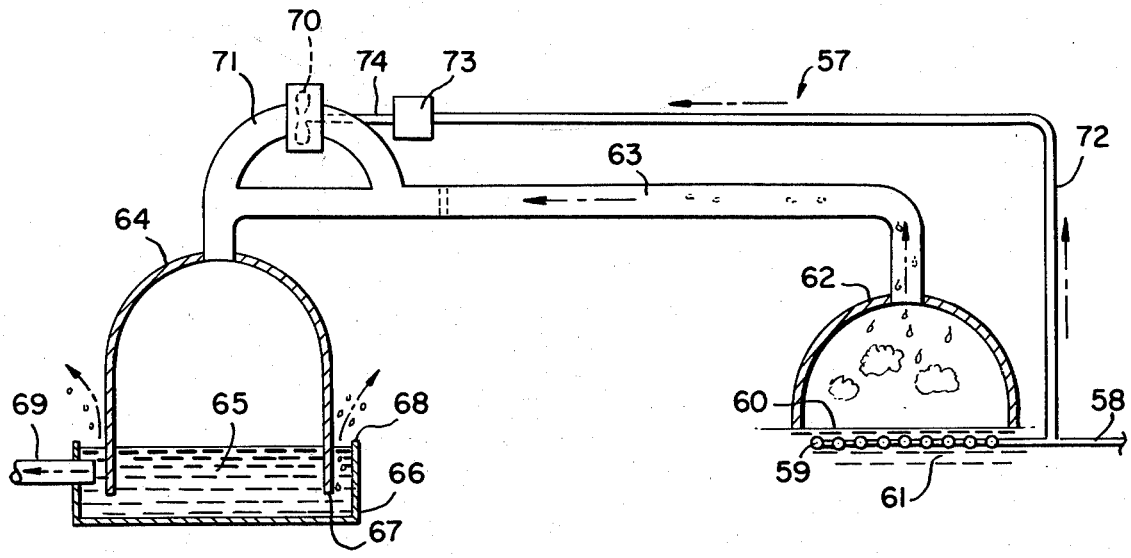
FIG. 4 is a diagrammatic illustration of a water purification apparatus operated by steam as produced by either of the embodiments of FIGS. 1–3.

FIG. 4 of the drawings depicts an arrangement wherein steam such as delivered by the supply line 32 or 51 serves as the energy utilized to purify water, which water in turn may be used for any suitable purpose including that serving as the source water for the inlet line 2 of the generating apparatus of either FIG. 1 or FIG. 3. The steam admitted to the steam supply line 58 is directed through a heat transfer mechanism such as a pipe grid 59 disposed immediately beneath the surface 60 of a body of impure water 61. Disposed atop the water surface 60 and over the pipe grid 59, is a vapor collection chamber 62 in turn communicating with a vapor transmission conduit 63. With the foregoing in mind, it will be understood that admission of steam to the pipe grid 59 will bring the impure water 61 adjacent thereto to a boil with the vaporized water accumulating within the collection chamber 62 and thence, rising and passing through the vapor transmission conduit 63. The vapors are transmitted to the interior of a condensing chamber 64 within which they condense and are collected as purified water 65 in a receptacle bottom 66. The lower edge 67 of the condenser chamber is dispoed within the body of water 65 at a point lower than and spaced inwardly from, the top edge 68 of the receptacle bottom 66 in order to allow the escape of pressure bubbles from the water body 65. An appropriate discharge 69 delivers the purified water by gravity to a reservoir or using apparatus.

Depending upon the relative level between the collection chamber 62 and condensing chamber 64, as well as the distance therebetween, appropriate means may be needed to insure the efficient transmission of the vapors between the two chambers by means of the conduit 63. Accordingly, it is proposed to include vapor propulsion means such as the fan 70, which will be seen to be disposed within a booster conduit 71 connected in parallel with the vapor transmission conduit 63. This fan 70 may most efficiently be driven by means of the steam being delivered from the supply line 58. In this regard, a steam drive line 72 directs a small portion of the steam from the supply line 58 to a suitable steam motor or turbine 73 which in turn operates the fan 70 by means of a drive shaft 74.

I claim:

1. A steam generation apparatus including, primary water heating means including at least one solar energy collector, a supply line providing water to said primary water heating means, a hot water storage tank, first inlet and outlet lines joining said primary water heating means in series with said storage tank, second inlet and outlet lines joining said primary water heating means to said hot water storage tank to provide recirculation of water therebetween, a high pressure-hot water tank, a line supplying hot water to said high pressure-hot water tank from said storage tank, pump means acting on said hot water in said high pressure-hot water tank to maintain water therein under pressure, supplemental water heating means including at least one solar energy collector, recirculating lines directing said hot water under pressure from said high pressure-hot water tank through said supplemental heating means and returning said hot water at a further elevated temperature to said high pressure-hot water tank, an expansion tank, a hot water delivery line from said supplemental heating means to said expansion tank, thermal valve means in said hot water deliver line adjacent said supplemental heating means operable to allow passage of hot water therethrough upon attaining a specified elevated temperature, pressure reducing valve means in said hot water delivery line adjacent said expansion tank, a steam outlet line extending from said expansion tank, and said expansion tank having a water return line adapted to receive condensation formed in said expansion tank.

2. A steam generation apparatus according to claim 1 wherein, said pump means includes a pump in said line supplying hot water to said high pressure-hot water tank.

3. A steam generation apparatus according to claim 1 wherein, said pump means includes an air compressor maintaining a pressure head atop said hot water in said high pressure-hot water tank.

4. A steam generation apparatus according to claim 1 wherein, said pump means maintains said hot water within said high pressure-hot water tank at substantially 300 psi.

5. A steam generation apparatus according to claim 1 including, a water purification unit connected to said steam outlet line.

6. A steam generation apparatus according to claim 1 wherein, said water return line communicates with said high pressure hot water tank.

7. A steam generation apparatus according to claim 1 wherein, said water return line communicates with said hot water storage tank.

8. A steam generation apparatus according to claim 5 including, heat transfer means joined to said steam outlet line within a body of impure water, a collection chamber disposed atop said heat transfer means to collect vapors generated thereby, a condensing chamber having a bottom pure water receptacle, and conduit means connecting said two chambers.

9. A steam generation apparatus according to claim 1 wherein, said primary water heating means includes a plurality of said collectors with said first inlet and outlet lines joined to a first one of said collectors and said second inlet and outlet lines joined to a second one of said collectors.

* * * * *